US005397068A

United States Patent [19]

Solomons et al.

[11] Patent Number: 5,397,068

[45] Date of Patent: Mar. 14, 1995

[54] DRY RUNNING MEDICAL WASTE DISPOSAL DEVICE

[75] Inventors: Charles Solomons, Thiells, N.Y.; Herbert R. Porter, Jr., Manasquan, N.J.

[73] Assignee: SPS Medical Equipment Corp., Roselle, N.J.

[21] Appl. No.: 141,866

[22] Filed: Oct. 22, 1993

[51] Int. Cl.[6] ..... B02C 19/00; B02C 13/16

[52] U.S. Cl. ..... 241/100; 241/37.5; 241/188.1; 241/194

[58] Field of Search ..... 241/37.5, 60, 98, 99, 241/188.1, 193, 194, 242, 257.1, 606

[56] References Cited

U.S. PATENT DOCUMENTS

| | | | |
|---|---|---|---|
| 3,584,334 | 6/1971 | Moriya | 241/188.1 X |
| 3,814,332 | 6/1974 | Nakao | 241/99 X |
| 4,741,482 | 3/1988 | Coggiola et al. | 241/37.5 |
| 4,892,258 | 1/1990 | Hughes | 241/188.1 X |
| 4,918,665 | 4/1990 | Herfeld | 241/98 X |
| 5,067,661 | 11/1991 | Eide | 241/188.1 X |
| 5,242,126 | 9/1993 | Bomze | 241/99 |

FOREIGN PATENT DOCUMENTS

| | | | |
|---|---|---|---|
| 2219581 | 4/1972 | Germany | 241/99 |

*Primary Examiner*—Timothy V. Eley

*Attorney, Agent, or Firm*—Israel Nissenbaum

[57] ABSTRACT

A compact medical waste disposal device, operable without water or other processing, disposal or disinfecting fluid or solution, for pulverizing Sharps into medically acceptably safe small particles, and directing the particles into a disposable container. The disposal device comprises a waste receiving and pulverizing chamber containing a pulverizing disc blade, with the disc blade being operable only when the pulverizing chamber is sealed. The pulverizing disc grinds the medical waste against the inner surface of a closely adjacent liner of the pulverizing chamber. Relatively heavy elements, rotatably swing on the upper surface of the pulverizing disc to direct medical waste materials and fragments, towards the pulverizing interface between disc and liner. Comminuted medical waste, falls beneath the blade into a disposal chamber, where a sweeper element, integral with the underside of the disc blade and rotatable therewith, continuously completely clears pulverized material, without fluid disposal carriers, into an outlet attached to a disposable container. The disc blade embodies at least one short recessed portion of the circumference thereof, preferably in the form of a flat, offset from the liner by up to $\frac{1}{8}''$, to permit resilient medical waste (rubber, plastic and similar materials) to pass therethrough without blade jamming.

8 Claims, 3 Drawing Sheets

DRY RUNNING MEDICAL WASTE DISPOSAL DEVICE

FIELD OF THE INVENTION

This invention relates to devices for the disposal of medical wastes and more particularly to devices for the dry pulverization and disposal of medical wastes such as needles, syringes, vials, extracted teeth, and the like.

BACKGROUND OF THE INVENTION

It is the general practice in the medical community for medical waste, such as used hypodermic needles and syringes as well as testing vials, to be thrown into specially sealed red (to indicate hazardous waste) containers. The containers are periodically collected by a disposal service and dumped into huge disposal machines which pulverize and sterilize or incinerate the waste for further normal disposal such as in a landfill. Because of the gap in both time and distance between initial use and ultimate disposal, as well as the considerable expense involved, there is opportunity for abuse such as by illegal ocean dumping which has resulted in contamination of beach and fishing resources. To obviate such problems, various devices for the on-site destruction of used needles, syringes, vials and other medical wastes have been developed such as described in U.S. Pat. Nos. 3,683,733; 3,750,966; 3,785,233; 3,926,379; 3,929,295; 3,958,765; 4,269,364; and 4,971,261. However, many of these devices are of a very complicated nature making their cost, for desk top use, in many instances, prohibitively expensive. In addition, they are of varying degrees of effectiveness in fragmentation of particles to governmentally mandated size (i.e. capable of passing through a ½" sieve) since their portable size militates against continued heavy duty fragmentation. The portable size also prevents use of industrial type heavy duty motors such as used in large scale pulverizers. Accordingly, a significant problem with such devices is blade jamming, particularly in those devices used in a dry environment without processing or carrier fluids such as water or disinfecting solutions. The problem with blade jamming is further exacerbated by the nature of common medical waste which includes rubber and plastic from syringes, as well as metal needle elements, which resist fragmentation and shredding. With medical waste disposal devices, blade jamming is a particularly vexing problem since the system is sealed to prevent spread of infectious materials. It is also therefore very difficult to remove the material causing the jam, without compromising the safety of the device designed to prevent personal exposure to the hazardous infectious materials. Furthermore, while some of these devices are generally capable of performing fragmentation operations, they are not capable of effecting the more desirable finely comminuted pulverization, as in centrally located large disposal machines.

SUMMARY OF THE INVENTION

The present invention comprises a compact medical waste disposal device, operable without water or other processing and/or disposal or disinfecting fluids, for pulverizing "Sharps" or medical waste materials into safe small particles (governmentally mandated medically acceptable small particles are at most ½" in size, as described above), and directing the particles into a disposable container. The disposal device comprises a waste receiving and pulverizing chamber containing a pulverizing disc blade as the base thereof, with the disc blade being operable, for safety reasons, only when the pulverizing chamber is sealed. The pulverizing disc grinds the medical waste against an inner surface of a closely adjacent liner (or shaped wall of the chamber itself) of the pulverizing chamber, having cooperative pulverizing elements such as teeth elements. The pulverized waste materials pass, in very finely comminuted particle form, between the disc and the liner into a pulverized waste catching chamber below the disc blade. The dry pulverized waste is then swept by sweeping means through an exhaust conduit into a disposable container attached to the other end of the exhaust conduit.

The disc blade preferably comprises waste directing elements which, upon rotation of the disc, direct the medical waste to the pulverizing interface between disc and liner. Preferred waste directing elements, for a pulverization disc, comprises two relatively heavy agitating elements, pivotally attached to the top of the disc (i.e. facing the medical waste being dropped into the device). The agitating elements are pivotally attached to the upper disc surface, at about the radius midpoints of the disc, and are aligned along a diameter, such that they rotatably swing and swivel on a large portion of the upper surface of the pulverizing disc. With such agitation, in conjunction with the centripetal forces of the spinning disc, medical waste materials and fragments, are continuously directed towards the pulverizing interface between disc and liner.

The device embodies a relatively heavy duty motor for imparting a strong rotational motion to the grinding disc. The disc further embodies jamming prevention means to obviate jamming, particularly endemic to the resilient and hard materials which comprise medical waste. Specifically, medical waste commonly comprises glass or plastic from vials and used hypodermic needles and syringes; rubber plunger elements of the needles and syringes; metals such as from needles; extracted teeth (usually from dental medical waste); and the like. The disc further embodies sweeper means which substantially completely continuously pushes or sweeps the dry pulverized medical waste to the exhaust conduit to continually remove such waste and prevent back-up.

It is an object of the present invention to provide a relatively simple and economical, yet effective device for on-site pulverization of medical waste to minimum sizes suitable for disposal in accordance with governmental standards.

It is a further object of the present invention to provide such device with a grinding or pulverization blade with reduced susceptibility to jamming even with dry processing conditions.

It is a still further object of the present invention to provide a device having a sweeper element to continuously direct comminuted particles to disposal containers.

These and other objects, features and advantages of the present invention will become more evident from the following discussion as well as the drawings in which:

SHORT DESCRIPTION OF THE DRAWINGS

DETAILED DESCRIPTION OF THE INVENTION

Figure 1:
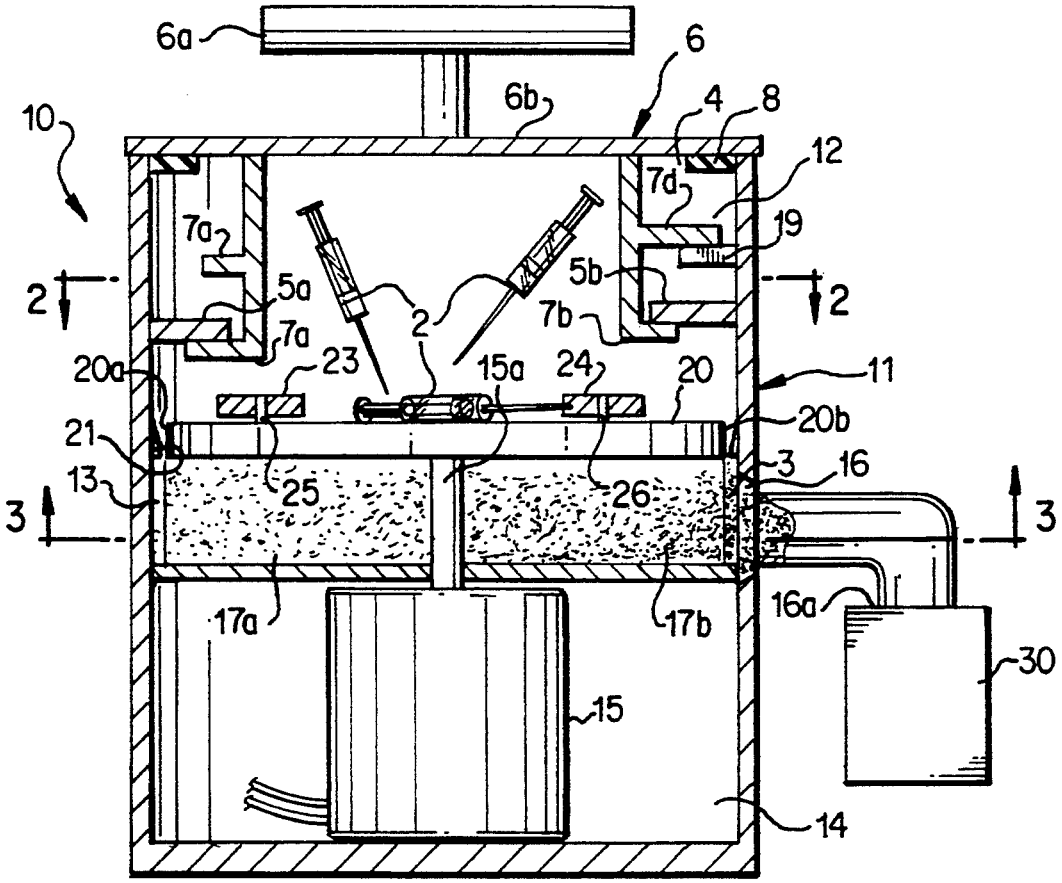
FIG. 1 is a side sectioned view of the device of the present invention, showing the operation thereof.

Generally the present invention comprises a compact medical waste disposal device akin to kitchen garbage disposal units which completely pulverizes medical waste, such as needles, syringes, vials, etc. Pulverization is effected in prior art kitchen garbage disposal units by means of a disc blade which is adjacent, with close tolerances, a waste chamber lining or the walls of the chamber itself which are provided with cooperative pulverizing elements such as teeth, rods, etc. A running stream of water aids in the pulverization, prevents jamming, and washes out the ground up wastes through a line connected directly to a municipal sewer system.

However, kitchen garbage disposal units, as currently configured are not suitable for medical waste disposal. Kitchen garbage disposal units, as exemplified by U.S. Pat. No. 3,013,736, require plumbing linkage to a continuous running water source and to a public sewer line for removal of waste water. However, it is undesirable to direct infectious medical waste materials (even in fragmented form) to public sewer lines. In addition, it is not always expedient or practical to create and/or dedicate plumbing lines for occasionally used medical waste disposal by relatively small scale users.

Kitchen type garbage disposal units also operate on a principal which is highly detrimental to use with medical waste, to wit, with the operation thereof, the waste inlet must be open to permit water ingress. With medical waste this can result in unsafe backsplash of highly infectious and dangerous matter in a communicable fluid medium. Accordingly, central pulverizing hospital waste disposal systems, such as described in U.S. Pat. No. 4,618,103, comprise large scale closed systems, operating with hammermills and constantly running disinfecting solutions, which facilitate the pulverizing process and which permit safe direct sewage disposal of disinfected waste materials, without backsplash problems, and with economical large scale plumbing facilities.

For economy, and facilitated small scale use, the medical waste disposal device of the present invention, though similar in structure and operation to a kitchen type garbage disposal unit, is neither connected with a sewer line nor is it utilized with fluid carriers such as water or disinfecting solutions. The device is operated as a dry medical waste pulverizer and disposal unit, whereby it is suitable for small scale use such as in a doctor's office or small medical clinic.

However, it has been discovered that using a portable or compact disposal unit, such as a kitchen garbage disposal unit, without a running fluid, results in problems, particularly with medical waste materials, of blade jamming and excessive ground up waste build up and back up.

Devices such as described in U.S. Pat. No. 5,186,402, obviate these problems by dedicating the disposal device to a particular medical waste, i.e. needles, which are fixed in an insertion position, rather than being randomly thrown in. Incidence of jamming is reduced, but at the cost of versatility and with additional time required for the careful emplacement of the needles. The device described therein is also provided with a fan element, positioned peripheral to a grinding disc, which literally blows the ground-up material out an exhaust tube. However, use of a fan is an inefficient and unreliable manner of exhausting especially when compared to fluid washing and actual physical contact removal.

In accordance with the present invention, jamming prevention means are embodied in the disc blade by shaping the blade whereby the disc embodies at least one short recessed portion of the circumference thereof, preferably in the form of a flattened area of the grinding circumference (a geometric chord of a circle, referred to hereinafter as a "flat"), offset from the liner by a maximum distance of 1/32" and up to ⅛". Because of the close tolerance between the disc and the liner, this distance is approximately equal to a maximum distance from the center of the flat to the center of the subtended arc of the circumference. The recessed portion, in the form of a flat, permits resilient medical waste (rubber, plastic and similar materials) to pass therethrough and prevent blade jamming, without also permitting excessively large particles to pass therethrough. The length of the recess or flat is dependent upon the circumference of the blade relative to the spacing desired. Thus, for example, with a common disc blade having a diameter of 5.5" and a maximum arc distance from the flat to the subtended arc of ⅛", length of the flat is about 1.64" in accordance with simple geometric relationships. Additional flats, if desired, are preferably symmetrically spaced around the disc (360°/number of flats), for greatest operating efficiency of the rotating disc.

After the medical waste is pulverized, the comminuted medical waste, falls beneath the blade into a disposal chamber, where a sweeper element, integral with the underside of the disc blade and rotatable therewith, continuously completely clears pulverized material, without fluid disposal carriers, into an outlet, leading to a removable disposable container. The sweeper element preferably comprises one or more metal elements attached to and perpendicular to the bottom of the pulverizing disc and extending a distance just short of the base of the disposal chamber, whereby little or no pulverized waste material is allowed to accumulate in the absence of a flushing fluid. Sweeper agitation members such as described in the aforementioned U.S. Pat. No. 4,971,261, tend to agitate rather than physically sweep the particles of medical waste out a disposal chute, or as in U.S. Pat. No. 3,013,736, to loosen the ground up medical waste to facilitate fluid flushing. Angled sweeper blades will, of course, provide the same effect, with proper placement, but are structurally less stable.

The exhaust outlet is preferably at the side of the disposal chamber, whereby the combination of sweeping and centripetal forces exerted by the rotating disc causes the pulverized waste material to move along the sweeper element toward and out the exhaust in continued successive sweeps of the sweeper element. Efficiency of exhausting is a function of disc speed, sweeper blade positioning, and exhaust vent size, with the major requirement being that pulverized waste material not be permitted to accumulate in the disposal chamber.

Exhausted pulverized waste material falling into the disposable disposal container is treated with a disinfectant, polymerically encapsulated, or otherwise treated as required by prevailing safety standards pertinent to pulverized medical waste.

DETAILED DESCRIPTION OF THE DRAWINGS AND THE PREFERRED EMBODIMENT

Figure 2:
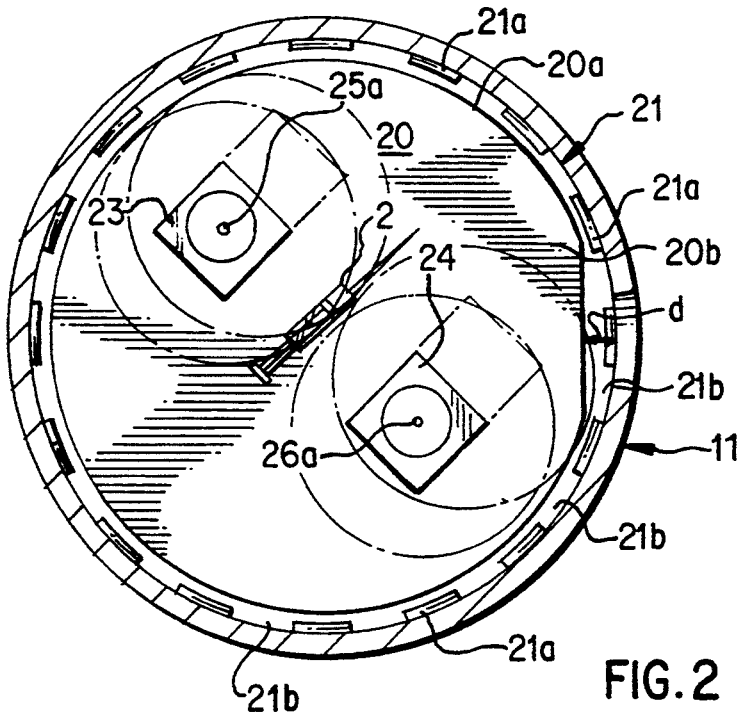
FIG. 2 is a view taken along line 2—2 of FIG. 1, showing the upper portion of the pulverizing disc.
Figure 3:
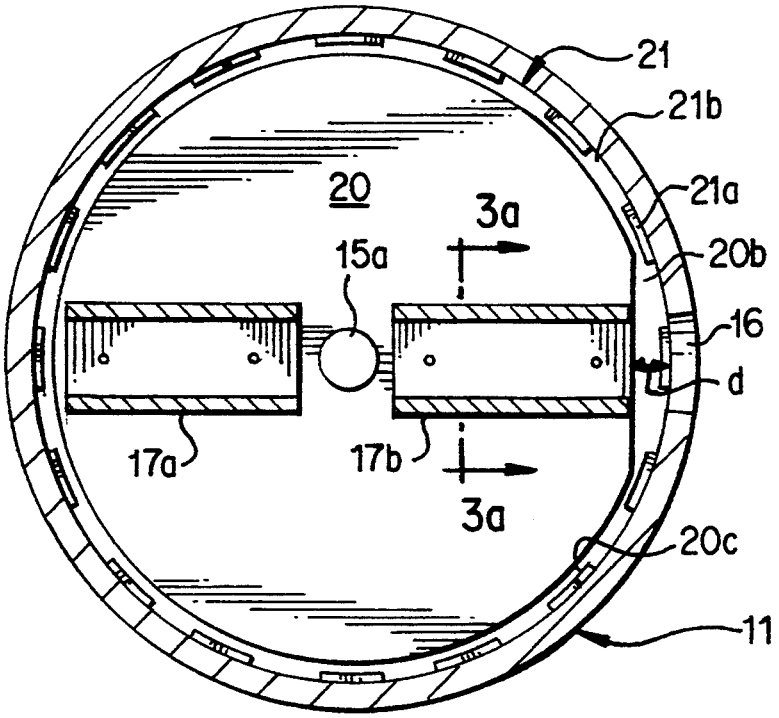
FIG. 3 is a view taken along line 3—3 of FIG. 1, showing the bottom portion of the pulverizing disc with sweeper element.
Figure 3A:
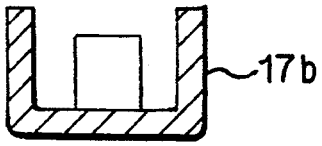
FIG. 3a is a cross section view taken along line 3a—3a of FIG. 3, showing the U-shaped cross section of the sweeper element.

With specific reference to the drawings, in FIG. 1, the disposal device 10, for disposal of medical waste such as needles 2, is shown with body 11, separated into a waste receiving and pulverizing chamber 12, a disposal chamber 13, and an enclosure 14, for 5 hp motor 15, sealed off from the medical waste containing chambers. Pulverizing disc 20, provides the base for the pulverizing chamber 12, and a separation between the pulverizing chamber 12 and the disposal chamber 13. Access for medical waste between the respective chambers is via the close spacing between outer peripheral edge 20*a* of disc 20 and the adjacent inner wall 21 of the device body 11, having numerous circumferentially placed very short tooth like protrusions 21*a*, shown more clearly in FIGS. 2 and 3. The interface between disc peripheral edge 20*a* and the teeth protrusions 21a provides the high abrasion for pulverization of the medical waste when disc 20 is driven by motor 15.

Agitation elements 23 and 24 are block metal elements restrained from axial movement by restraining washers 25*a* and 26*a* respectively on retaining pins 25 and 26 respectively, away from disc 20 but are freely movable along the surface of the disc, for a distance and over an area, as shown in the dotted lines. Elements 23 and 24 are rectangularly shaped and non-centrally positioned on pins 25 and 26 respectively, and when pivoted on pins 25 and 26 respectively, swivel and swing on upper surface 20, as shown by the dotted lines in FIG. 2. The surface movement and weight of the block metal elements agitates medical waste, falling on the disc, and the medical waste is directed, with the centripetal force resulting from the disc rotation, to peripheral edge 20*a* for pulverization thereof. The spacings 21*b*, between the respective teeth 21*a*, permits the pulverized waste 3 to pass therethrough to the disposal chamber 13 below. However, medical waste material, of a rubber or resilient plastic nature, as commonly found in syringes, may become compressed and caught within such spacing 21*b*. As a result, with the high frictional forces associated with such materials and the relatively (compared to 50 hp motors used in centrally located pulverizers) low horsepower motor, disc jamming may occur on occasion, without any safe access to unclog the jam (kitchen garbage disposal units do permit access for release of jamming, such as may be caused by wedged bones, which cannot be readily washed away).

Accordingly, disc 20 comprises flat 20*b* (more clearly seen in FIGS. 2 and 3), which is spaced from the inner wall 21, by a maximum distance d of between 1/32" to $\frac{1}{8}$". Upon continued rotation of the disc 20, potentially jamming material encounters the additional spacing afforded by the flat and jamming does not occur.

Pulverized material 3 falls into the disposal chamber 13 and would normally be slowly blown out exhaust opening 16 but at a rate insufficient to prevent build-up of pulverized waste and possible back-up, upon continuous operation. Sweeper elements 17*a* and 17*b*, (as seen more clearly in FIG. 3) in the form of inverted U shaped metal members, are affixed to the underside of disc 20 on either side of motor shaft 15*a*. The sweeper elements 17*a* and 17*b* extend substantially across the entire height of the disposal chamber whereby waste accumulation is quickly and efficiently completely swept away to the exhaust opening 16 and into container 30 attached to the opposite end 16*a* of the exhaust to complete the disposal of the medical waste.

Figure 4:
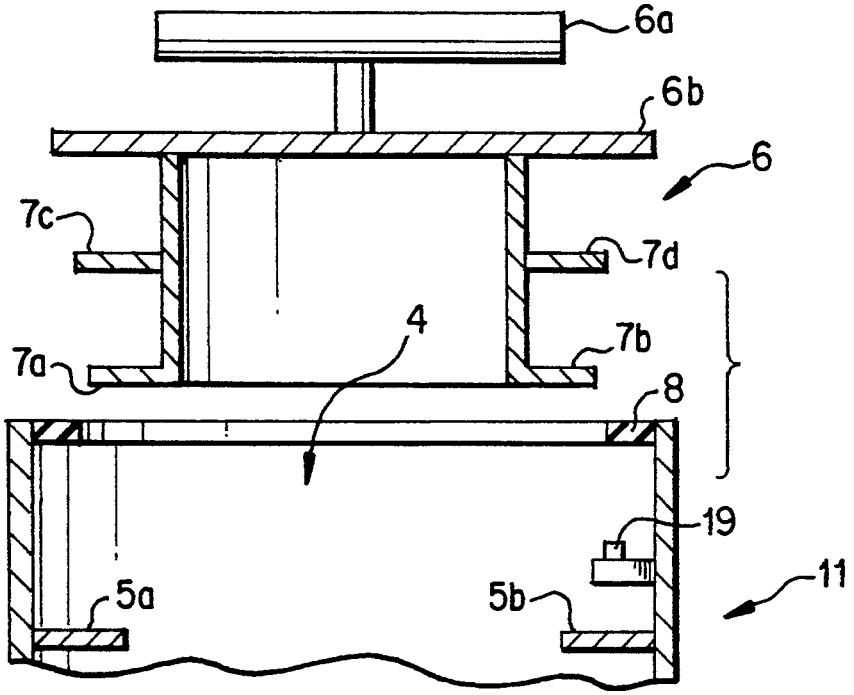
FIG. 4 is a separated view of the safety closure of the device and the safety interlock of the device of FIG. 1.
Figure 5:
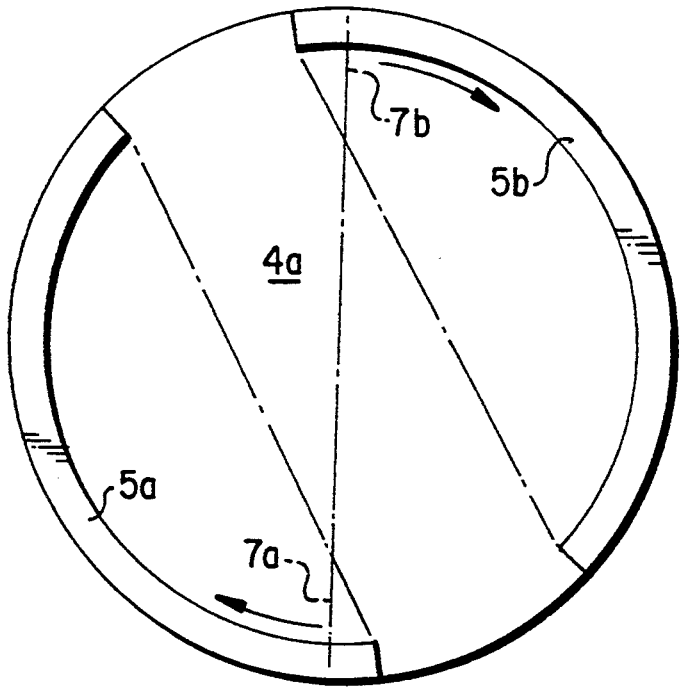
FIG. 5 is a top view of the body of the open device.

As shown in FIGS. 1 and 4, inlet 4 permits loading of the device with medical waste such as needles 2. Closure member 6, with handle 6*a* is removed for such loading. When operation of the device is desired, closure member 6 is fully inserted into opening 4 into spacing 4*a* and rotated, as indicated in FIG. 5, bayonet fashion, until retaining flanges 7*a* and 7*b* engage flanges 5*a* and 5*b*.

This causes locking the closure member 6 circular upper flange 6*b* in a sealed position, with rubber gasket 8. The closure member 6 is thereby seated and sealed on the end of body 11, whereby no external backsplash of hazardous material is possible during the pulverizing operation. Seating and sealing of the closure member 6 to the body 11, to seal off the pulverizing chamber 12, also activates safety cut-off switch 19 with flange 7*c* or 7*d* (depending on insertion orientation), whereby pulverizing only occurs with the closure member in the sealed position and switch 19 being constantly depressed.

It is understood that the above discussion, preferred embodiment and drawings are exemplary of the device of the present invention and that changes in structure, components and relative placement, is possible without departing from the scope of the present invention as defined in the following claims.

What is claimed is:

1. A medical waste disposal device, operable without fluid, for pulverizing medical waste materials into particles no larger than a pre-determined small size, and directing the particles into a diposable container, the disposal device comprising a chamber for receiving medical waste and wherein said medical waste is pulverized; said chamber containing a pulverizing rotating disc having a circumference, with a peripheral pulverizing surface situated closely adjacent an inner surface of the pulverizing chamber, said disc being adapted to pulverize the medical waste, during rotation thereof, against the closely adjacent inner surface, the device further comprising a disposal chamber defined at an upper end thereof by said disc, wherein pulverized medical waste, falls beneath the disc into said disposal chamber; wherein the device further comprises means for removing the pulverized medical waste from the disposal chamber to said disposable container; and wherein said disc embodies at least one short recessed portion of the circumference thereof, whereby sufficient space is provided to permit pulverization resistant medical waste, no larger than said predetermined small size, to pass through said recessed portion without jamming of the disc, wherein said short recessed portion comprises a chord on the circumference of the disc.

2. The medical waste disposal device of claim 1, wherein said chord is spaced from an arc of the disc circumference subtended thereby, by a maximum distance ranging from $\frac{1}{8}$–1/32".

3. The medical waste disposal device of claim 2, wherein said disc comprises at least two chords symmetrically disposed around the circumference of said disc.

4. The medical waste disposal device of claim 2, wherein said disposal chamber is defined at a lower end by a base, with said pulverized medical waste falling on said base, wherein the disposal chamber further comprises an exhaust opening leading to said disposable container, and said means for removing the pulverized medical waste, from the disposal chamber, comprises at least one sweeper member extending substantially completely from said disc to said base, with said sweeper member moving with movement of said disc through the entire disposal chamber, to effect the removing of the pulverized medical waste through said exhaust opening.

5. The medical waste disposal device of claim 4, wherein said sweeper member comprises at least one metal plate perpendicularly attached to said disc.

6. The medical waste disposal device of claim 4, wherein said device comprises means for prevention of rotation of said disc unless said waste receiving and pulverizing chamber is sealed.

7. The medical waste disposal device of claim 4, wherein said device comprises means to direct medical waste, placed in said waste receiving and pulverizing chamber, to the pulverizing surface of the disc.

8. The medical waste disposal device of claim 7, wherein said means for directing medical waste to the pulverizing surface of the disc comprises two agitating elements, pivotally attached to the top of the disc, facing the medical waste being dropped into the device, with said agitating elements being pivotally attached to the disc, at about midpoints of two radii of the disc, and aligned along a diameter, such that the agitating elements rotatably swing and swivel on a large portion of a surface of the pulverizing disc.

* * * * *